United States Patent [19]

Grocke

[11] 4,064,678

[45] Dec. 27, 1977

[54] APPARATUS FOR DRAWING A SIDE-FOLDED TUBE OVER PILED OBJECTS

[75] Inventor: Diethelm Grocke, Nurnberg, Germany

[73] Assignee: Nutro Patentverwertungs-und Maschinen-Handels GmbH, Nurnberg, Germany

[21] Appl. No.: 738,046

[22] Filed: Nov. 2, 1976

[30] Foreign Application Priority Data

Nov. 4, 1975 Germany ..... 2549251

[51] Int. Cl.[2] ..... B65B 43/34

[52] U.S. Cl. ..... 53/183; 53/384

[58] Field of Search ..... 53/183, 187, 241, 384

[56] References Cited

U.S. PATENT DOCUMENTS

| | | | |
|---|---|---|---|
| 3,778,960 | 12/1973 | Christensen et al. | 53/183 X |
| 3,925,964 | 12/1975 | Birkenfeld et al. | 53/183 |

*Primary Examiner*—Travis S. McGehee

*Attorney, Agent, or Firm*—Brown, Murray, Flick & Peckham

[57] ABSTRACT

Apparatus for drawing side folded tube over objects piled on a base, the apparatus being provided with a welding and separating device and an opening device for opening and drawing over the tube fed in flatly pressed form. The opening device is in the form of four pairs of rotatably supported members each acting on a respective side fold of the tube.

8 Claims, 4 Drawing Figures

APPARATUS FOR DRAWING A SIDE-FOLDED TUBE OVER PILED OBJECTS

BACKGROUND OF THE INVENTION

This invention relates to a apparatus for drawing a side-folded tube over objects piled on the base, the apparatus being provided with a welding and separating device and a device for opening and drawing-over the tube fed in flatly pressed form, this latter device being in the form of four devices each acting on one of the side folds.

In a side-folded tube, not only do the side folds which lie against each other in pairs by their outsides mutually adhere, but the tube parts which lie against each other by their insides also mutually adhere, because of static and heat adhesion. It is known (DT-AS 1,761,895) to dispose guide plates in front of gripping devices which are required to grip a flatly pressed tube, which feed not only the side folds but also the entire tube in a suitable form for gripping. It is also known (DT-GM 918,817) to provide, in combination with gripping devices which are required to grip a flatly pressed tube only at the side folds, a side fold guide in the form of mobile suckers which pull the side folds apart. It is also known (DT-PS 1,940,783) to dispose in front of gripping devices which are required to grip only the side folds, a side fold guide in the form of wedges which push the side folds apart. The withdrawal movement of the side folds which initially lie against each other in pairs may be carried out either at the same time as opening the flatly laying tube (DT-AS 1,761,895, DT-PS 1,938,960, DT-GM 813,256), or before opening the tube (DT-GM 6,918,817, DT-PS 1,940,783, DT-OS 2,026,860). The gripping devices, which serve for opening the tube, are for example suckers (DT-GM 813,256) or clamps (DT-OS 2,026,860), or rods inserted into the tube (DT-PS 1,938,960). In all known apparatus, the tube is fed by a pair of driven feed rollers, disposed in front of the side fold guide. It is also known (FR-PS 2,106,654) to continuously open the tube upwards by mobile clamps gripping the side folds, and to drive the tube downwards by means of gripping devices in the form of bolts gripping into the tube. It is also known to eliminate the side fold adhesion before moving the side folds apart (DT-OS 2,206,273). Finally it is also known (DT-OS 2,315,900) to dispose horizontally slidable clamping devices for opening a tube, and to move them downwards together with rearwardly disposed gripping devices for drawing-over a cover.

SUMMARY OF THE INVENTION

An object of the invention is to provide a device of the initially described type wherein the side fold guide moves apart two side folds lying together, in such a manner that when the side folds have been moved apart the distance between two opposing side folds in the direction of the tube width is not less than the tube width, and wherein no special devices for eliminating the side fold adhesion are required. A further object of the invention is to reduce the resources required for the tube feed and side fold guide. A still further object is to reduce the resources required for opening the tube and moving the side folds apart. A side fold guide is then provided which allows any possible device for completely opening the tube, to be used with advantage, i.e. for example not only clamps but also rods inserted into the tube and suckers of simple construction gripping the tube from outside may be used for operating purposes. Another object of the invention is to provide a simplifed device for opening purposes, by which the tube is opened continuously upwards by mobile clamps gripping the side folds.

The invention provides apparatus of the initially described type, characterised in that each of the devices acting on one of the side folds consists of a pair of rotatably supported turned pieces which clamp the side folds therebetween.

The particular advantage of such a gripping device in the form of a pair of turned pieces is that it firstly holds the forward moving tube without it slipping along the gripping device, and secondly is of extremely simple construction. The turned pieces, which may be rolls, rollers or wheels, have the same speed as the forward moving tube at the point in which they grip the tube, and require little expense.

Where a clamping device for each side fold is disposed below a side fold guide, the two respective clamping devices associated with two neighbouring side folds being slidable relative to each other in a horizontal direction and upwardly and downwardly mobile gripping devices being provided under the clamping devices, then the invention provides in particular for the clamping devices to be in the form of pairs of clamping wheels.

In apparatus according to the invention, each of the four sides folds is led into one of the pairs of clamping rollers and clamped thereby. As the tube is fed to the drawing-over position, the clamping rollers also turn, at least one clamping roller per pair being driven. The drive for the pair of clamping rollers is made as synchronous as possible, to prevent the tube slipping and distorting. The outer surface of the clamping rollers is such that the pair of clamping rollers can exert a powerful pull on the tube, either by choice of material or outer surface structure.

The side folds are led into the pairs of clamping rollers in such a manner that the distance between two side fold edges lying opposite each other across the width of the flatly lying tube is equal to the tube width. The edges of the side folds remain in this position during tube feed, as the clamping rollers hold the side folds firmly and also keep the tube drawn apart in the same plane in which it lay flat. The pairs of clamping rollers draw apart two side folds which initially lay against each other, this itself overcoming the strongest adhesion between the side folds. Any desired length of tube may be run through the pairs of clamping rollers, and the adhesion be overcome without disturbance.

Under certain circumstances, it is advantageous to omit a driven pair of feed rollers. In this case, the pairs of clamping rollers take over the tube feed, i.e. they draw it from a supply spool and feed it to the drawing-over position. The length of the two clamping rollers of each pair of clamping rollers is chosen according to requirements. Where the pairs of clamping rollers draw from the supply spool, the length over which the two clamping rollers of one pair press against each other is relatively large.

It is also particularly desirable and advantageous if the pairs of clamping rollers are disposed in such a manner that they open the tube. As the pairs of clamping rollers hold the tube exceptionally firmly, they can also be used to break the adhesion in the tube. Such a preopened, i.e. partly opened tube can then be fully opened with any desired gripping devices, as there are no more adhesive forces to overcome, and rod-type gripping devices may be inserted into the tube interior. The overall device for complete opening may be of small dimensions, as it need apply only relatively small forces in the opening process.

The tube may for example be opened by disposing the two pairs of clamping rollers associated with one pair of neighbouring side folds at a suitable distance from each other, with the clamping roller axes extending exactly at right angles to the tube conveying direction. It is however particularly desirable and advantageous if the axes of the clamping rollers of each of the pairs of clamping rollers are inclined to the horizontal. As in this case the side folds are continously driven outwards from the interior of the apparatus by the driven pairs of clamping rollers, the tube is stressed between two opposing pairs of clamping rollers such that it opens by breaking the adhesion. A slight sloping of the axes of the clamping roller pairs towards the interior of the apparatus is in any case an advantage, in preserving a distance corresponding to the tube width between two opposing side fold corners. With steeper inclination, e.g. 5° to 10°, the tube opens. Each pair of clamping rollers may extend over approximately the entire width of the associated side folds, or the clamping rollers may grip only a strip of the side folds, possibly close to the side fold edge. This latter is for example advantageous where preopening of the tube is required.

The invention also provides apparatus of the initially described type, wherein a clamping device for each side fold is disposed below a side fold guide, the two respective clamping devices associated with two neighbouring side folds being slidable relative to each other in a horizontal direction, and upwardly and downwardly mobile gripping devices being provided under the clamping devices, characterised in that the clamping devices are in the form of pairs of clamping wheels.

With such apparatus, the side folds, moved apart for example by suckers or wedges, are led by suction into the open pairs of clamping wheels. These then close and move away from each other, so substantially completely opening the tube. If the tube is now drawn downwards by the gripping devices gripping the lower part of the tube, the tube becomes continuously opened by the pairs of clamping wheels. The pairs of clamping wheels in terms of expense are extremely simple devices for opening and holding firm the tube, and because of the wheel rotation move with the tube during the drawing-over process. If the pairs of clamping wheels are provided in association with driven pairs of clamping rollers which pre-open the tube, then even with relatively low clamping force of the pair of clamping wheels, there is no danger of the side folds being drawn out of the pair of clamping wheels by any adhesion present.

It is particularly desirable and advantageous in this case if the pairs of clamping wheels are mobile upwards and downwards. Where the gripping devices have fed such a length of tube downwards that the distance between the pairs of clamping wheels and the gripping devices corresponds approximately to the height of the cover under manufacture, then the pair of clamping wheels and gripping devices are moved downwards together until the cover has been drawn completely over the piled object. This notably decreases the total height of the apparatus.

BRIEF DESCRIPTION OF THE DRAWINGS

The drawings show a preferred embodiment of the invention, wherein:

The apparatus as shown in the drawings, comprises a base 2, such as a palette, on which objects 3 are piled, lies on a runway 1, such as a conveyor belt or a track with a trolley, and is located with the objects in a frame 4. This carries upwardly at its centre a pair of feed rollers 5, at least one of which is drivable, and which draw a tube 6 from a supply spool, not shown. The tube comprises four side folds 7, each of which passes through a pair of driven clamping rollers 8, disposed below the feed rollers 5. As shown in FIG. 1, the axes 9 of the clamping rollers are inclined to the horizontal at an angle 10. Of each pair of clamping rollers, the clamping roller between two neighbouring side folds 7 is in the form of a longitudinal cylinder, and the clamping roller lying externally on the side fold is short and in the form of a wheel. All clamping rollers 8 are connected together as shown in FIG. 4 by pinions, chains and axles, so as to obtain synchronous running, in which the outer diameter of all clamping rollers is as far as possible equal, in order to obtain uniform conveying of all four side folds, for which the outer clamping rollers may for example be larger than the inner ones. Below the pairs of clamping rollers 8 there is provided a two part welding and separating device 11, the parts of which are horizontally slidable relative to each other on supports 12, and may also be pivoted rotatable relative to each other. The tube is pre-opened by the pairs of clamping rollers and runs downwards, guided by guide plates (not shown) between the parts of the welding and separating device 11, in only a slightly open condition. Below the welding and separating device 11 there is provided a pair of clamping wheels 13 for each side fold, mobile on a horizontal rail 15 by means of a carriage 14. The clamp formed by the clamping wheels 13 may be opened by means of a device 14*a*, so that the side folds may run into the pairs of clamping wheels 13, when these have run together in pairs under the pairs of clamping rollers 8. The pairs of clamping wheels 13 thenclose and travel apart, so that the lower end 16 of the tube complete opens.

Figure 1:
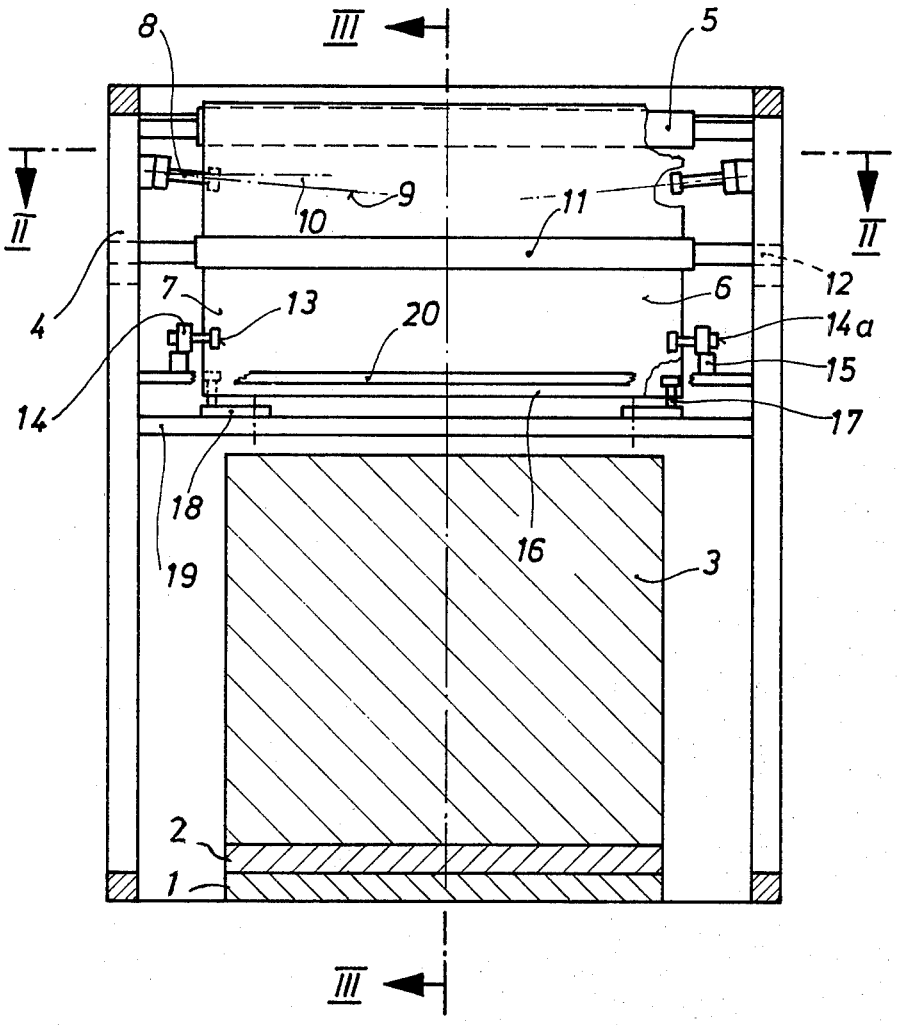
FIG. 1 is a side view of a device for drawing-over a side-folded tube.
Figure 2:
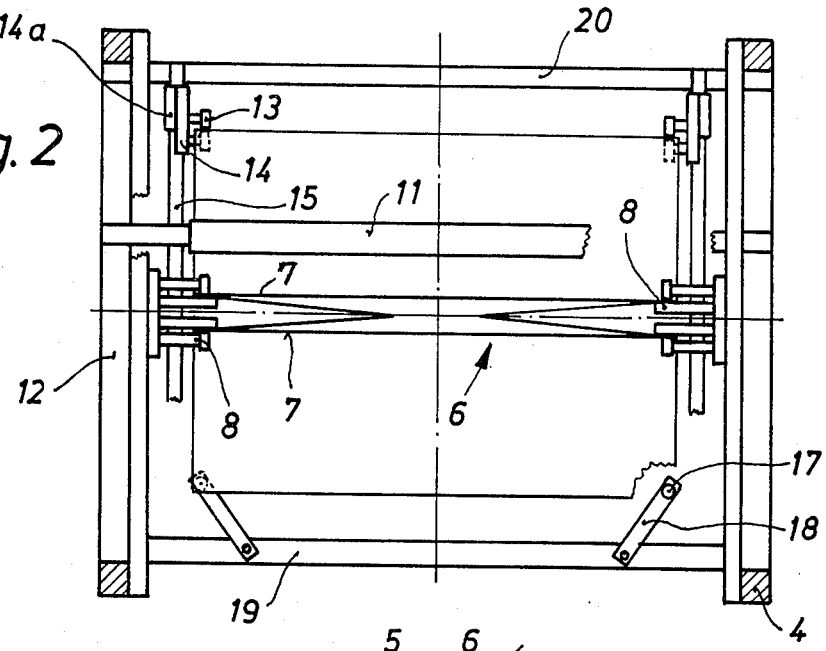
FIG. 2 is a section on the line II—II of FIG. 1.
Figure 3:
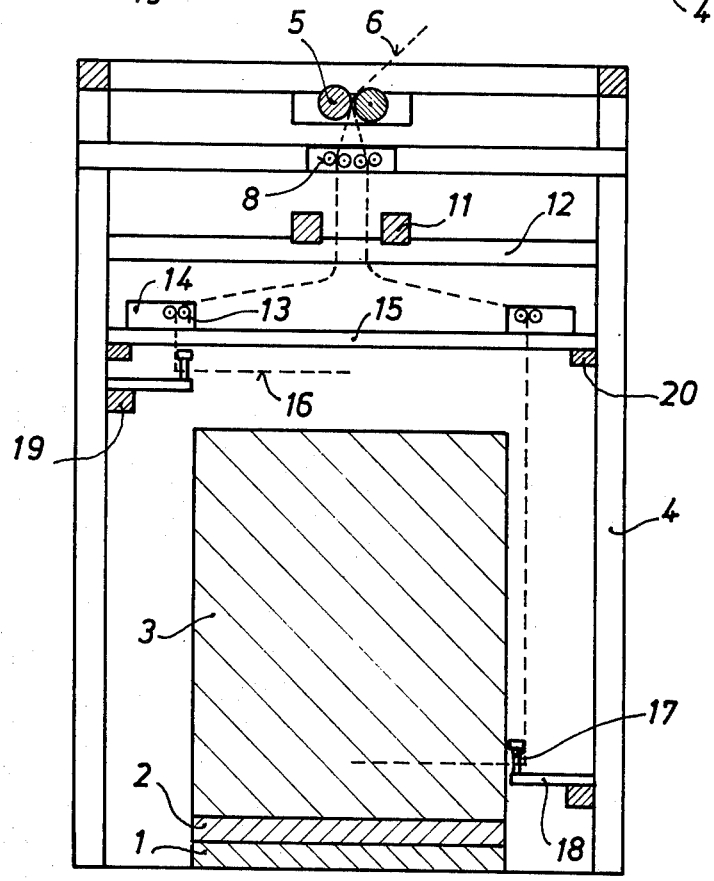
FIG. 3 is a section on the line III—III of FIG. 1.

Below the pairs of clamping wheels 13, there is provided one vertical tension bolt 17 for each side fold, which leads from below into a tube end piece projecting downwards past the pairs of clamping wheels. Each tension bolt is situated at the free end of a horizontal arm 18 rotatably supported about a vertical axis on a frame 19, and movable into the corner of the tube by means of an unillustrated device. When the four tension bolts 17 travel into the four corners of the tube, the tube becomes stretched and is gripped by them. The frame 19 then travels downwards until approximately in the position shown to the right in FIG. 3. The welding and separating device now acts, cutting the drawn portion of tube off and forming an upwardly closed cover. The frame 19 and a frame 20 carrying the rails 15 then travel together downwards. The tension bolts further pull the portion of separated cover lying above the pairs of clamping wheels 13 as far as possible through the pairs of clamping wheels. The pairs of clamping wheels are then opened and the cover is pulled by the tension bolts completely over the objects 3. The tension bolts 17 then release the tube by swivelling, and are pulled out of the tube from underneath.

Figure 4:
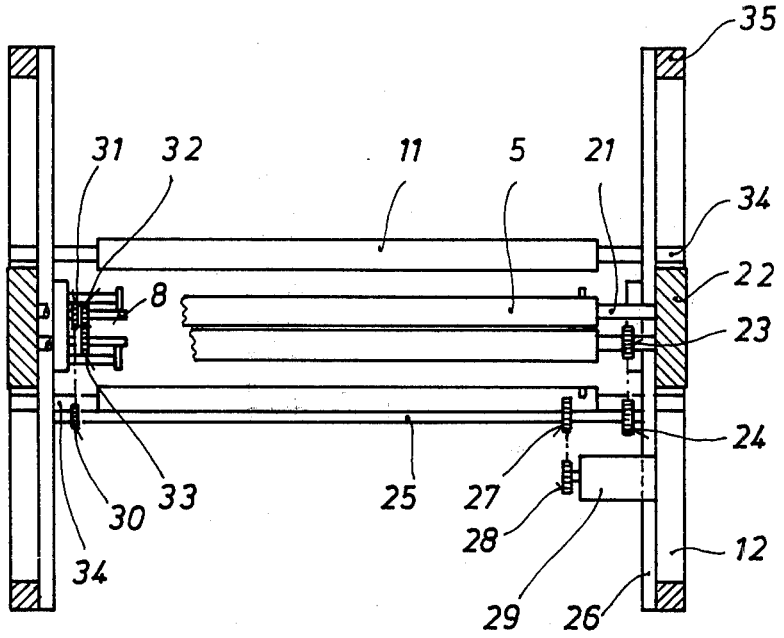
FIG. 4 is a plan view of a drive for feed rollers and clamping rollers for the device as shown in FIG. 1, and represents a horizontal section through FIG. 1.

In FIG. 4, the two feed rollers 5 are each rotatably supported in blocks 22, one of which carriers a pinion 23, which is driven through a chain by a pinion 24 located on a shaft 25 rotatably supported in struts 26 of the frame 4. The shaft 25 carries a pinion 27 turned through a chain by a pinion 28, which is driven by an electric motor 29 fixed on one of the struts 26. At each end of the shaft 25 a pinion 30 is provided, of which only one is shown in FIG. 4. By way of a chain, this pinion 30 drives a pinion 31 located on one of the two inner clamping rollers 8 of two mutually associated pairs of clamping rollers. The two inner clamping rollers 8 each carry a gear wheel 32, 33 which engage with each other. FIG. 4 also shows that the two parts of the welding and separating device 11 are each slidable, by means of extensions 34, on the supports 12 which each extend between two uprights 35 of the frame 4.

The extensions 34 to the parts of the welding and separating device 11, are made to slide along the supports 12 in a manner (not illustrated), by endless chains, to which the extensions are fixed and which pass over pinions mounted on the supports, at least one of the pinions being driven. Each carriage 14 is fixed in unillustrated manner to an endless chain passing over pinions supported on the rail 15, at least one of the pinions being driven. The frame 19 is made to move upwards and downwards in an unillustrated manner by means of an endless chain to which the frame is fixed, and which passes over pinions, at least one of which is driven. The frame 20 is also made to move upwards and downwards in an unillustrated manner by means of an endless chain to which this frame is fixed, and which passes over pinions, at least one of which is driven. The arm 18 is made to swivel in an unillustrated manner by means of pneumatic piston-cylinder devices.

I claim:

1. Apparatus for drawing a side-folded tube fed in flatly pressed form from above over objects piled on a base, the tube having two pairs of side folds, comprising welding and separating means for the side-folded tube, side-fold guiding means for moving apart the side-folds of each pair of folds, a pair of non-driven clamping wheels for engaging each side-fold and movable toward and away from each other and disposed below said guiding means, the two pairs of clamping wheels associated with each adjacent pair of side-folds being movable away from each other in a horizontal direction to open the tube and maintain it open, and tube-gripping means under said clamping wheels movable upwardly and downwardly for drawing said tube down through said wheels and over said piled objects.

2. Apparatus according to claim 1, wherein said clamping wheels are mounted on upwardly and downwardly movable supporting means.

3. Apparatus according to claim 1, wherein said side-fold guiding means are formed by four pairs of driven clamping rollers, each pair being associated with and in continuous engagement with a respective side-fold of the tube.

4. Apparatus according to claim 3, wherein said clamping wheels are mounted on upwardly and downwardly movable supporting means.

5. Apparatus according to claim 3, wherein said side-fold guiding means are formed by four pairs of driven clamping rollers having axes inclined inwardly and downwardly, and each pair of said rollers being associated with and in continuous engagement with a respective side-fold of the tube.

6. Apparatus according to claim 5, wherein said clamping wheels are mounted on upwardly and downwardly movable supporting means.

7. Apparatus for drawing a side-folded tube in flatly pressed form from above over objects piled on a base, the tube having two pairs of side-folds, comprising welding and separating means for the side-folded tube, side-fold guiding means for moving apart the side-folds of each pair of folds, said guiding means being formed by four pairs of driven clamping rollers each associated with and in continuous engagement with a respective side-fold, and tube-engaging devices associated with the four side-folds of the tube below said rollers for opening the tube and drawing it down over said piled objects.

8. Apparatus according to claim 7, wherein the axes of said clamping rollers are inclined inwardly and downwardly.

* * * * *